United States Patent [19]

Longo et al.

[11] 4,450,184

[45] May 22, 1984

[54] HOLLOW SPHERE CERAMIC PARTICLES FOR ABRADABLE COATINGS

[75] Inventors: Frank N. Longo, East Northport; Nicholas F. Bader, III, Farmingdale; Mitchell R. Dorfman, East Meadow, all of N.Y.

[73] Assignee: METCO Incorporated, Westbury, N.Y.

[21] Appl. No.: 349,288

[22] Filed: Feb. 16, 1982

[51] Int. Cl.[3] ..... B05D 1/10; B05D 5/02

[52] U.S. Cl. ..... 427/34; 427/423; 428/402

[58] Field of Search ..... 427/423, 34; 428/570, 428/402, 406, 472, 471, 403, 404

[56] References Cited

U.S. PATENT DOCUMENTS

| | | | |
|---|---|---|---|
| 4,039,297 | 8/1977 | Takenaka | 428/570 X |
| 4,290,847 | 9/1981 | Johnson et al. | 427/6 |
| 4,303,732 | 12/1981 | Torobin | 428/403 |
| 4,303,737 | 12/1981 | Litchfield et al. | 428/406 |
| 4,349,456 | 9/1982 | Sowman | 264/4 |

OTHER PUBLICATIONS

Preparation and Characterization of $ZrO_2$ and $HfO_2$ Microballons, Gilman, Ceramic Bulletin, vol. 46, No. 6 (1967), pp. 593–595.

*Primary Examiner*—Shrive P. Beck

*Attorney, Agent, or Firm*—F. L. Masselle; E. T. Grimes; J. D. Crane

[57] ABSTRACT

A hollow sphere ceramic flame spray powder is disclosed. The desired constituents are first formed into agglomerated particles in a spray drier. Then the agglomerated particles are introduced into a plasma flame which is adjusted so that the particles collected are substantially hollow. The hollow sphere ceramic particles are suitable for flame spraying a porous and abradable coating. The hollow particles may be selected from the group consisting of zirconium oxide and magnesium zirconate.

5 Claims, No Drawings

HOLLOW SPHERE CERAMIC PARTICLES FOR ABRADABLE COATINGS

BACKGROUND OF THE INVENTION

This invention relates broadly to the field of abradable coatings and particularly to a material which is flame sprayed onto a substrate to produce an abradable coating thereon.

Flame spraying involves heat softening of a heat fusable material, such as a metal or a ceramic, and propelling the softened or molten material in fine particulate form against the surface to be coated. The heat softened or melted material, on striking the surface, becomes bonded thereto.

Typical flame spray guns use either a combustion or a plasma flame to provide the heat for melting the powder, although other heating means, such as electric arcs, resistance heaters or induction heaters may be used alone or in combination with a flame spray gun. In a powder-type combustion flame spray gun, the carrier gas for the powder can be one of the combustion gases, or it can be compressed air. In a plasma flame spray gun, on the other hand, the primary plasma gas is generally nitrogen or argon. Hydrogen or helium is usually added to the primary gas. The carrier gas is generally the same as the primary plasma gas, although other gases, such as hydrocarbons, are used in certain situations.

The nature of a coating obtained by flame spraying a metal or ceramic powder can be quite specifically controlled by proper selection of the composition of the powder, control of the physical nature of the powder and use of select flame spraying conditions. For example, it is well known and common practice to flame spray a simple mixture of ceramic powder and metal powder. Coatings produced by spraying mixtures usually contain both the ceramic and the metal material that has been flame sprayed and have desirable characteristics such as being abradable, hard, erosion resistant etc., depending on the materials being sprayed and the spraying conditions.

Abradable thermal barrier coatings require a highly porous coating network of 20–35% porosity, which cannot be achieved by conventional flame spray techniques. The porosity levels achieved by such conventional techniques for ceramic coatings using conventional powders normally range between 5 and 20%, and the porosity level, it has been found, is a direct function of the powder size and spraying parameters, e.g., spray rate, spray distance and power levels of the spray gun.

Another approach for producing an abradable coating is described in U.S. Pat. No. 4,299,865 wherein an abradable material is codeposited on the substrate to be coated with a thermally decomposable filler powder. Once the desired coating thickness is achieved, the coated substrate is heated to a temperature high enough to decompose the filler powder thereby leaving an abradable coating, which is about 20 to 30% void.

This approach requires that the coated article be subjected to heat in order to decompose the filler powder. This may be inconvenient or difficult depending on the physical size of the coated article. Additionally, the process described is likely to require very accurate control in order to reliably produce the desired coating.

Because abradable coatings are highly desirable in certain applications, such as clearance control in gas turbine engines, the problem of developing an abradable coating using flame spraying techniques has been investigated by others in order to obtain the desired levels of porosity. In addition to the above approach, yet another appoach has been investigated. This approach utilizes a temperature-resistant aluminum silicate hollow sphere filler (e.g., Eccospheres TM) which is ultimately distributed throughout the ceramic coating and remains intact, even after exposure to elevated temperatures.

There are several problems with Eccosphere TM sprays. One problem is that the material does not spray well, i.e., the amount of material which can be sprayed in a given time period is small. Coatings so produced also have limited cohesive bond strength and are very friable. The material additionally has a low melting point so it is not particularly suitable for use in high temperature environments.

Accordingly, it is the principal objective of the present invention to provide a powder for flame spraying onto a substrate a coating which is abradable.

It is still another objective of this invention to provide a flame spray powder for producing an abradable coating which is not expensive to produce.

It is still a further objective of the invention to provide a powder for producing an abradable coating which is suitable for use on parts which are used at high temperatures.

BRIEF DESCRIPTION OF THE INVENTION

The above and other objectives are achieved by using a powder of refractory oxides formed in hollow spheres and flame spraying the powder onto the desired substrate. The powder is made starting with an agglomeration of powders. The powders are combined with a water soluble organic binder and water to form a slurry. The slurry is pumped to a spraying nozzle, located in a spray dryer, where pressurized air is introduced to atomize the slurry material. The atomized droplets are propelled upwardly into a counter current of heated air which evaporates the water in the particles leaving dried porous particles which are collected and screened to a specific size.

The sized agglomerated particles are then fed into a high temperature, low velocity nitrogen/hydrogen plasma that will allow the particles to remain at a high temperature for a sufficient time to fuse into a homogenized structure comprising particles in the form of hollow spheres. These powder particles can thereafter be flame sprayed onto a substrate to form an abradable coating thereon.

DETAILED DESCRIPTION OF THE INVENTION

Hollow sphere particles useful for producing abradable coatings are manufactured, according to the present invention, in the following manner. An agglomerated powder, having the desired weight proportions for the raw materials, is first manufactured using a spray drying process such as is described in U.S. Pat. No. 3,617,358. Thereafter, a sized powder from the spray drying process is introduced into a high temperature, low velocity nitrogen/hydrogen plasma that allows the powder particles to remain at an elevated temperature for an extended period of time. This allows the constituents of the spray drying powder to become partially or fully homogenized. By controlling the parameters in connection with the operation of the plasma and the introduction of the powders into that plasma, the powder particles formed thereby are changed into hollow spheres with an essentially solid shell. The hollow spheres can then be plasma sprayed onto a substrate to form a fine and evenly dispersed network having a porosity in the order of between 20 and 30% and additionally possessing both erosion resistance and abradable characteristics.

Hollow sphere particles are manufactured by first blending fine powdered raw materials in the desired weight proportions. Examples of such raw materials include zirconium oxide, hafnium oxide, magnesium oxide, cerium oxide, yttrium oxide or combinations thereof. One example of a desirable blend is one including 93% by weight of zirconium oxide (zirconia) and 7% by weight of yttrium oxide (yttria) powders. It is also possible to use fine powders of a single constituent, such as yttrium oxide. Another example is fine powder of magnesium zirconate, or alternatively, a blend of fine powders of 50 mol percent zirconium oxide and 50 mol percent magnesium oxide.

A water soluble organic binder, such as CMC or PVA, plus a sufficient amount of water, is mixed with the powdered raw materials to form a slip or slurry. Typically, the percentage of binder concentration ranges between 1 to 3% while the percentage of solids and viscosity thereof can vary between 65 and 85% solids and 100–800 centipoises. In the manufacture of hollow ceramic zirconia yttria spheres, it has been found useful to have a 1% by weight binder concentration, 150 centipoises viscosity and 75% solids in the slip or slurry. The slip is then thoroughly mixed and pumped to the nozzle in a Stork-Bowen spray dryer or the like where pressurized air is introduced to atomize the slip. The greater the pressurized air flow, the finer the atomized particles.

The moist atomized droplets are propelled upwardly into a counter current flow of heated air which causes the water within the atomized droplets to evaporate, leaving dried porous particles that drop into a lower portion of the chamber where they are collected.

A typical set up for the Stork-Bowen spray dryer for the manufacture of agglomerated particles to be used in the subsequent steps is as follows:

Air pressure (psi) 35
Cyclone vacuum 4.5
Inlet/Outlet temp. 820°/355° F.
Chamber vacuum 1.6
Viscosity (centipoises) 160
Specific gravity 2.4
Binder concentration 1%

Following the agglomeration procedure in the spray dryer, the particles collected from the bottom of the chamber are screened to a specific size (e.g., −100 to +230 mesh). All of the off-size material is suitable for recycling because it readily breaks down in water and can be added to the beginning of another slip.

After screening, the next step in the process of making hollow sphere particles is to fuse the particle constitutents into a partially or fully homogenized hollow structure. This is accomplished by feeding the agglomerated particles into a high temperature, low velocity nitrogen/hydrogen plasma produced by a Metco Type 7MB plasma spray gun directed in a vertically downward direction. The plasma and the particles carried thereby are contained by a vertically disposed open ended water cooled tube about 4 feet in length and about 18 inches in diameter. A collector funnel or the like is disposed at the bottom end of the tube to collect the particles.

Typical plasma spray gun operating conditions are as follows:

size: −100 to +230 mesh
Spray Rate: 5 lbs/hr.
Carrier (Pressure/flow): 55 psi/10 cfh
Powder Port: Metco No. 4
Amps: 900
Volts: 74
Primary/Secondary Gas Pressure: 50/50 psi
Pri/Sec Gas Flow: 60/10 cfh In typical operation, the feed rate may vary from about 5 to 15 lbs/hr and the power levels may vary from about 40 to 75 kw. depending on the particle size of the powder and the degree of alloying or homogenization desired. The primary gas is nitrogen and the secondary gas is hydrogen. The flow for primary gas is 60–100 SCFH and for secondary gas is 0–20 SCFH.

After passing the porous agglomeration of micron size particles through the plasma flame, the particles collected are hollow with an essentially solid shell having a thickness of between about 2% and 20% of the particle diameter. It is not understood at this time exactly why hollow particles are produced. There are, however, several theories as to why the spheres are hollow. One possible explanation is that gases may be trapped inside the particles. This may occur because the binder, when it breaks down in the flame, produces gas which is included within the particle. Another explanation is that partial alloying or surface glazing occurs which causes a shell to be formed. A third possible explanation is that the molten particles in the flame may be superheated causing hollow spheres to be made. Yet another possible explanation is that nitrides may be formed within the ceramic which decomposes in the presence of atmospheric oxygen forming the hollow spheres. It is also possible that two or mre of these effects are jointly operative to produce the hollow spheres.

The finished flame spray powder should have a particle size between −100 mesh (U.S. standard screen size) and +5 microns, and preferably between −120 mesh and +325 mesh.

Powders produced by the complete process described above have improved flowability and higher bulk density compared with the agglomerated powders produced by the spray dry oven itself. For example, zirconia/yttria powder, the spray dry product has a flow of 50 seconds while the end product output has a flow of 30 seconds using the Hall test according to ASTM B123. The bulk density of the former is 1.54 g/cc while of the latter it is 2.23 g/cc. As a result, the product of the present process can be sprayed at higher rates and spraying is more controlled. Therefore, the porosity of the resulting coating can be controlled better. Indeed, yttria stabilized zirconia coatings produced using hollow sphere powder produced in accordance with the present invention provides a coating with about 27% porosity which is highly desirable although unachievable using other known yttria stabilized zirconia powders.

In addition to the refractory oxides already mentioned, other materials can be made into spheres, including aluminum oxide, chromium oxide, nickel oxide and titanium oxide. Some materials, such as zirconium oxide, may include stabilized or partially stabilized forms thereof. The term refractory oxide as used herein, however, is meant to exclude any oxide having silica as a major constituent, as they have been found to be less desirable or undesirable as far as they are used to produce abradable coatings However, minor amounts of silica may be included.

In achieving coatings which are abradable, it has been found that the refractory oxide spray powder according to the present invention should have an apparent density in the range of 15% to 50% of the theoretical density of ordinary solid refractory oxide material (the same as the spray powder) that has been fused or sintered, the apparent density measured according to ASTM method B212.

The manufacturing process above produces a powder in which the particles are substantially hollow. The term substantially hollow in this context means that at least about 60% of the particles in the powder are hollow. Those of skill in the art will also realize that varying the parameters used in the manufacturing process will affect the percentage of hollow sphere particles in the powder produced. It may be desirable for the hollow sphere powder of this invention to be blended with another ordinary flame spray powder to achieve some increased porosity and abradability. The percent by weight of hollow spheres in the blend should be at least 10% and preferably at least 40%.

It will be observed that throughout the specification various materials and proportions thereof, as well as equipment operating conditions, have been specified. This has been done purely for clarity and reader convenience and is not intended as a limitation on the materials or apparatus operating conditions or as a limitation on the scope of the invention.

What is claimed is:

1. A process for producing an abradable porous coating comprising flame spraying hollow spheres made of a refractory metal oxide selected from the group consisting of zirconium oxide and magnesium zirconate where each hollow sphere has a size between about −100 mesh, U.S. standard screen size, and +5 microns.

2. The process of claim 1 wherein said refractory oxide may additionally include magnesium oxide, hafnium oxide, cerium oxide, yttrium oxide and combinations thereof.

3. A process according to claim 1 in which said hollow spheres have a size preferably between about −120 mesh and +325 mesh U.S. standard screen sizes.

4. A process according to claim 1 in which said hollow spheres have an apparent density of approximately 15% to 50% of theoretical density.

5. A process according to claim 1 in which said flame spraying is effected with a plasma flame spray gun.

* * * * *